US005523659A

United States Patent [19]

Swenson

[11] Patent Number: 5,523,659

[45] Date of Patent: Jun. 4, 1996

[54] RADIO FREQUENCY FOCUSED DRIFT TUBE LINEAR ACCELERATOR

[76] Inventor: Donald A. Swenson, 115 Morene Ave., Waxahachie, Tex. 75165

[21] Appl. No.: 292,487

[22] Filed: Aug. 18, 1994

[51] Int. Cl.[6] ..... H01J 23/08; H01J 23/00; H05H 7/00

[52] U.S. Cl. ..... 315/506; 315/500; 315/507

[58] Field of Search ..... 315/5.34, 5.41, 315/500, 505, 506, 507

[56] References Cited

U.S. PATENT DOCUMENTS

| | | |
|---|---|---|
| 3,501,734 | 3/1970 | Knapp et al. . |
| 4,211,954 | 7/1980 | Swenson . |
| 4,485,346 | 11/1984 | Swenson et al. . |
| 4,596,946 | 6/1986 | Pottier . |
| 4,906,896 | 3/1990 | Swenson . |
| 5,014,014 | 5/1991 | Swenson . |
| 5,113,141 | 5/1992 | Swenson . |

OTHER PUBLICATIONS

E. D. Courant and H. S. Snyder, "Theory of the Alternating–Gradient Synchroton", Annl. Phys. 3, 1–48 (1958).

L. Smith and R. L. Gluckstern, "Focusing in Linear Accelerators", *RSI* vol. 26, No. 2 (1950).

A. Carne, P. Lapostolle, B. Schnizer, and M. Prome, "Numerial Methods, Acceleration by a Gap", *Linear Accelerators*, North–Holland Publishing Company, pp. 747–783, (1970).

A. Carne and P. M. Lapostolle, "Design Equations in an Alvarez–Type Proton Linear Accelerator", Proc. of 1966 Linac Conf., pp. 201–206.

I. M. Kapchinskii and V. A. Teplyakov, "Linear Ion Accelerator with Spatially Homogeneous Strong Focusing", Prib. Tekh. Eksp., No. 2, pp. 19–22 (1970).

I. M. Kapchinskii and N. V. Lazarev, "The Linear Accelerator Structures with Space–Uniform Quadrupole Focusing", IEEE Trans, Nucl. Sci. NS–26, 3462 (1979).

D. A. Swenson, "Low–Beta Linac Structures", Proc. of 1979 Linac Conf., pp. 129–136.

R. H. Stokes, K. R. Crandall, J. E. Stovall, D. A. Swenson, "Rf Quadrupole Beam Dynamics", IEEE Trans. Nucl. Sci. NS–26 3469 (1979).

S. O. Schriber, "High–Beta Linac Structures", Proc. of 1979 Linac Conf., pp. 164–174.

I. M. Kapchinskii, "History of RFQ Development", Proc. of 1984 Linac Conference, pp. 43–46.

D. A. Swenson, "Extensions to the RFQ Domain", Particle Accelerators, 1990, vol. 32, pp. 21–26.

V. A. Teplyakov, "RFQ Focusing in Linacs", Proc. of 1992 Linac Conference, pp. 21–24.

*Primary Examiner*—Sandra L. O'Shea
*Assistant Examiner*—John Ning
*Attorney, Agent, or Firm*—McAndrews, Held, & Malloy, Ltd.

[57] ABSTRACT

A drift tube linac incorporates rf-electric quadrupole focusing by employing drift tubes with only one drift-tube stem per particle wavelength and in which the lowest frequency RF cavity mode has a transverse magnetic field ($TM_{010}$-mode). Each drift tube comprises two separate electrodes that form a capacitor that couples to the axial electric field of the primary cavity mode. The electrodes operate at different electrical potentials, as determined by the RF fields in the cavity, and are supported by a single stem along the axis of a cylindrical cavity. Each electrode supports two fingers pointing towards the opposite end of the drift tube, forming a four fingered geometry that produces an RF quadrupole field distribution along its axis. The fundamental periodicity of the structure is equal to the particle wavelength ($\beta\lambda$) where $\beta$ is the particle velocity in units of the velocity of light and $\lambda$ is the free space wavelength of the rf. The particles traverse two distinct regions, namely the gaps between drift tubes, where the acceleration takes place, and the regions inside the drift tubes, where the RF focusing takes place. The linac of the present invention transforms the reverse fields into transverse fields for focusing such that the beam is not decelerated.

10 Claims, 7 Drawing Sheets

RADIO FREQUENCY FOCUSED DRIFT TUBE LINEAR ACCELERATOR

FIELD OF THE INVENTION

The present invention relates to an apparatus for accelerating a beam of charged particles, and more particularly to a drift tube loaded linear accelerator suitable for accelerating protons (hydrogen nuclei) and heavier ions in the velocity range of about 0.05 to about 0.50 times the velocity of light. In the present invention, each drift tube contains an array of electrodes that couple to the primary electromagnetic fields in the structure to produce a radio frequency ("RF") electric quadrupole field along the axis of the drift tube to focus the particle beam. The resulting structure offers improved performance over the conventional drift tube linac (DTL) and the possibility of smaller, more efficient, and less costly accelerator systems for scientific, industrial, medical and defense applications.

BACKGROUND OF THE INVENTION

Particle accelerators are machines built for the purpose of accelerating electrically charged particles to kinetic energies sufficiently high to produce certain desired nuclear reactions, ionization phenomenon, and/or materials modification processes. Typically, charged particles from an "ion source" are collimated into a "beam" and injected into accelerating structures, where they follow certain trajectories under the influence of bending, steering, focusing and accelerating fields until they have reached the required energy. At this point, the beam is typically extracted from the accelerator system and directed onto a "target", where the desired reactions occur. The by-products of these reactions can be used for scientific, medical, industrial and military applications.

Linear accelerators (linacs) are the technology of choice for the acceleration of charged particles (atomic ions) from their sources (ion sources) to the desired particle energy or to particle energies where other types of accelerators, such as synchrotrons (circular accelerators), are preferred. For protons, this often encompasses the energy range from 30 kilo-electron-volts (keV) to hundreds of million-electron-volts (MeV), or a velocity range from about 0.008 to about 0.8 times that of light.

Linacs generally involve evacuated, metallic cavities or transmission lines, filled with radio-frequency (RF) electromagnetic energy waves that result in strong alternating electric fields that can accelerate charged particles. Linac art is categorized by the properties of the RF waves, yielding two types of linacs, namely standing wave linacs and traveling wave linacs. Alternatively, linacs may be classified according to the particle velocities that they accommodate. Generally speaking, standing wave linacs are used for particle velocities less than half the speed of light (low beta linacs). Both standing wave and traveling wave linacs are used for higher velocities. At velocities close to that of light, traveling wave linacs predominate.

Common stranding wave linac structures include the relatively new radio frequency quadrupole (RFQ) linac structure, which has taken over the lowest velocity end of the linac business, the Wideröe linac, which is sometimes used for acceleration of low energy, heavy ions, the drift tube linac (DTL) structure, which holds the middle-velocities of the linac business, and the coupled cavity linac (CCL) structure, which carries the high velocity end of the standing wave linac business.

Linacs accelerate charged particles along nominally straight trajectories by means of alternating electric fields applied to linear arrays of electrodes located inside evacuated cavities. The alternating electric fields in these evacuated metallic cavities or transmission lines result from the excitation of electromagnetic cavity modes with radio frequency electromagnetic energy. Electrode spacings are arranged such that particles arrive at each gap between electrodes in an appropriate phase of the electric field to result in acceleration at each gap.

The capabilities of conventional linacs for accelerating high beam currents at low energies are severely limited by the available strengths of the conventional magnetic focusing elements, used to keep the beam diameters small enough to enable efficient interactions with the RF electric accelerating fields. In the development of linac technology, there have been numerous attempts to utilize electric :fields for the focusing forces, which, unlike magnetic fields, are independent of particle velocity and promise superior performance at the lower particle velocities. Scientists have considered both static electric quadrupole fields and time-dependent (radio frequency) electric quadrupole fields for this role.

In the early 1970's, two Russian scientists introduced the revolutionary idea of "spatially uniform strong focusing", which offers the capability of simultaneously focusing, bunching and accelerating intense beams of charged particles with RF electric fields in one compact structure, which subsequently became known as the Radio Frequency Quadrupole (RFQ) linac structure. The RFQ linacs represent the best transformation between the continuous beams that come from ion sources and the bunched beams required by most linear accelerators. Their forces, being electric, are independent of particle velocity, allowing them to focus and bunch beams at much lower energies than possible for their magnetically focused counterparts. Their capture efficiency can approach 100% with minimal emittance growth. RFQ linacs have made a major impact on the design and performance of proton, deuteron, light-ion, and heavy-ion accelerator facilities. They have set new performance standards for accelerators and in doing so have earned a role in most future proton and other ion accelerators.

However, RFQ linacs are not without limitations. In all RFQ linac structures, the acceleration rate is inversely proportional to the particle velocity. At some point in the process of particle acceleration, the acceleration rate drops to the point where some change in the acceleration process is desired. Unfortunately, in the conventional RFQ structure, there are no changes that can be made to the basic structure to rectify the inherent deterioration of the acceleration rate that occurs with higher velocities. As a result, for all but the lowest energy applications, RFQ linacs must be followed by different accelerating structures such as magnetically focused drift tube linacs (DTL), which offer higher acceleration rates in the energy ranges just beyond the practical limits of the RFQ structures up to velocities as high as half that of light. However, the magnetic focusing at this point is generally weaker than the electric focusing utilized in the RFQ structures. Consequently, matching the beam from an electrically focused RFQ linac into a magnetically focused DTL linac—often requiting several additional focusing and bunching elements and an array of beam diagnostic equipment to manage the transition—tends to be too complex and expensive for most commercial applications.

Thus, it would be valuable if this transition could be shifted to higher energies, where magnetic focusing is stronger, by either extending the energy capabilities of the RFQ structures or developing new rf-focused structures that would interface more naturally with the beams that come from RFQ linacs. In either case, new developments in linac structures would be required. However, once the beam is tightly bunched and focused in an RFQ linac, there is less need for the "spatially uniform" feature of the fields. By dropping that constraint, several avenues open up for extending the useful energy range of rf-focused linac structures.

Swenson U.S. Pat. No. 5,113,141 introduced an improved RFQ linac structure to extend the useful energy range of the conventional RFQ linac structure. The invention introduced a new degree of freedom into the system by configuring the structure as individual, four-finger-loaded acceleration/focusing cells, the orientation of which would be chosen to optimize performance. This new degree of freedom made the acceleration periodicity independent of the focusing periodicity, thus allowing the operating frequency to be raised as needed to enhance the acceleration rate without jeopardizing the required focusing action.

Another approach is to develop new linac structures based on a combination of conventional accelerating cells and four-finger-loaded focusing cells. The Russians have developed such structures to accelerate protons from 2 MeV to an energy of 30 MeV for injection into their major accelerator at Serpukov. The Russian structures involve successions of drift tubes, supported on a variety of stems, immersed in rf-cavity modes with a longitudinal magnetic field (H-modes). Half of the gaps are loaded with four fingers to supply the focusing, while the other gaps are dedicated to the acceleration. This configuration involves four or more drift tube stems per particle wavelength—a serious penalty, particularly at low particle velocities and high RF frequencies.

The present invention represents a new linac structure that combines the superior focal properties of the RFQ with the superior acceleration properties of the DTL linac. It offers strong rf-focusing and efficient RF acceleration for particles at velocities beyond that which is practical for the RFQ structure. In preferred configurations, its requires only one stem per particle wavelength.

Therefore, an object of the present invention is to provide a commercially viable linear particle accelerator suitable for interfacing with an RFQ linac to accelerate protons and heavier ions in the velocity range of about 0.05 to about 0.50 times the velocity of light.

Another object is to provide a drift tube linear accelerator excited in the $TM_{010}$ RF cavity mode with RF focusing of the accelerated beam incorporated into each drift tube.

A further object is to provide a drift tube linear accelerator capable of being miniaturized.

SUMMARY OF THE INVENTION

To achieve the foregoing and other objects, and in accordance with the purposes of the present invention, the apparatus of this invention comprises a configuration of electrodes, resembling a DTL, offering efficient acceleration and RF quadrupole focusing for charged particles traveling at velocities beyond that normally considered practical for conventional RFQ linacs. The present invention combines the strong RF focusing of the RFQ linac with the efficient acceleration of the DTL to form the Rf-Focused Drift-tube ("RFD") linac such that ion energies from 1 MeV to 150 MeV can be achieved at a relatively low cost. This application is particularly useful for smaller, commercially viable ion linacs.

The invention relates to an if-focused structure requiring only one drift-tube stem per particle wavelength and utilizing the lowest frequency RF cavity mode with a transverse magnetic field ($TM_{010}$-mode). In a preferred embodiment, each drift tube comprises two separate electrodes that form a capacitor that couples to the axial electric field of the primary cavity mode. The electrodes operate at different electrical potentials, as determined by the RF fields in the cavity, and are supported by a single stem along the axis of a cylindrical cavity. Each electrode supports two fingers pointing inward towards the opposite end of the drift tube, forming a four fingered geometry that produces an RF quadrupole field distribution along its axis. The fundamental periodicity of the structure is equal to the particle wavelength, $\beta\lambda$, where $\beta$ is the particle velocity in units of the velocity of light and $\lambda$ is the free space wavelength of the rf. The particles traverse two distinct regions, namely the gaps between drift tubes, where the acceleration takes place, and the regions inside the drift tubes, where the RF focusing takes place.

The present invention does not replace or compete with the conventional RFQ structure, but rather is designed to extend the performance of the RFQ structure by accelerating the small diameter, tightly bunched beams that come from the RFQ linac to higher energies. The present invention also lends itself to miniaturization more readily than its magnetically focused counterpart.

An advantage of the present RFD is that its size, cost and performance are ideal for the production of short-lived radioisotopes for use in medical technology based on positron emission tomography, for use as an injector to a proton synchrotron, and for producing energetic neutrons for non-destructive testing.

DETAILED DESCRIPTION OF THE PREFERRED EMBODIMENT

Figure 1:
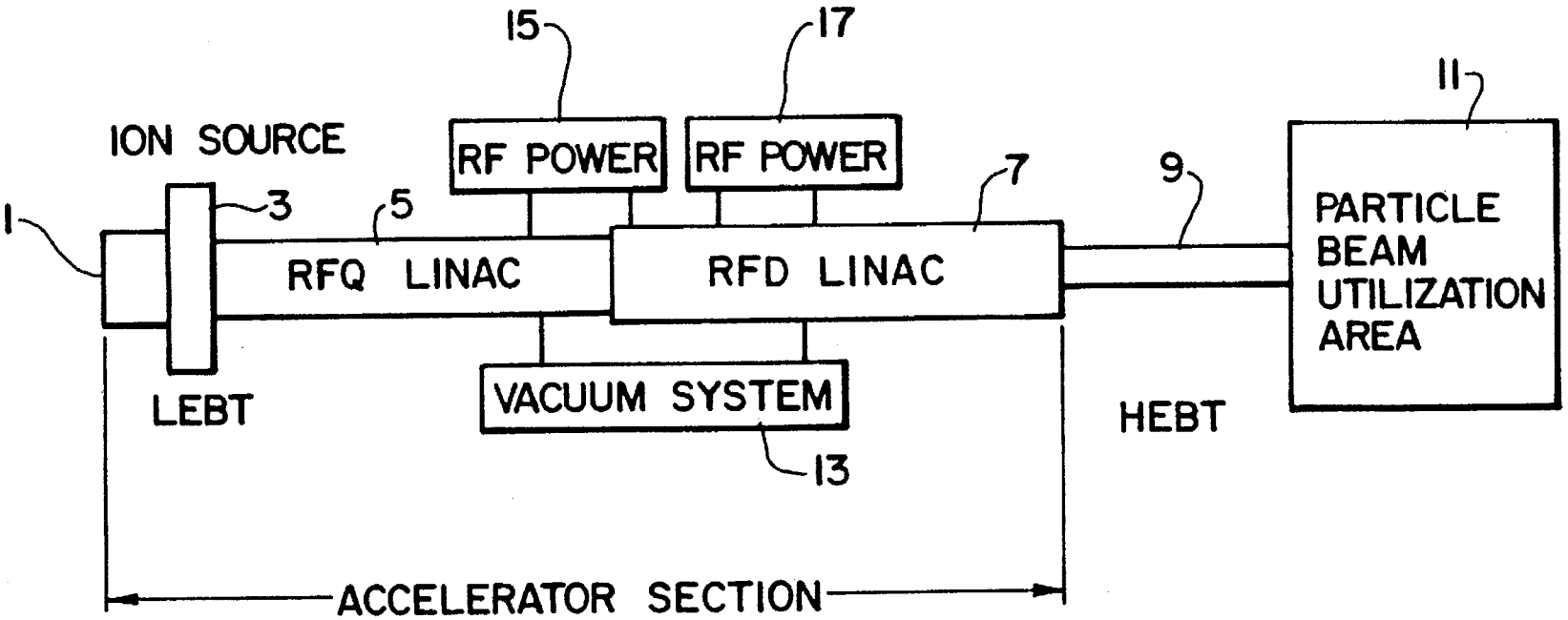
FIG. 1 is a block diagram of a complete particle accelerator system using the new RFD linac structure.

The RFD linac structure of the present invention is shown in FIG. 1 as part of a complete particle acclerator system. An ion source 1 fires a collimated beam of charged particles into a low energy beam transport system (LEBT) 3, which focuses and steers the charged particle beam into a conventional RFQ linac 5. The RFQ linac 5 uses RF electric fields to focus, bunch and accelerate the charged particles to a higher energy, where the small diameter, tightly bunched beam from the RFQ linac 5 is injected into the RFD linac 7. The RFD linac 7, with its RF electric focusing and acceleration fields is able to maintain the small beam diameter and tight bunching of the beam while accelerating the particle beam to the final energy. The particle beam is fired into a high energy beam transport system (HEBT) 9, which focuses and steers the beam at high energy into the particle beam utilization area 11, where the particle beam may be used for scientific, medical, industrial and/or commercial applications.

The two linac structures 5, 7 are evacuated by the vacuum pumps of the linac vacuum system 13. The ion source 1, the two beam transport systems 3, 9, and the particle beam utilization area 11 have their own vacuum pumping systems (not shown). The two linac structures 5, 7 are powered by the self-excited linac RF power systems 15, 17. For some modest 10-MeV proton applications, the accelerator section may be only 2 meters long, thus qualifying as a "table-top" model.

Figure 2A:
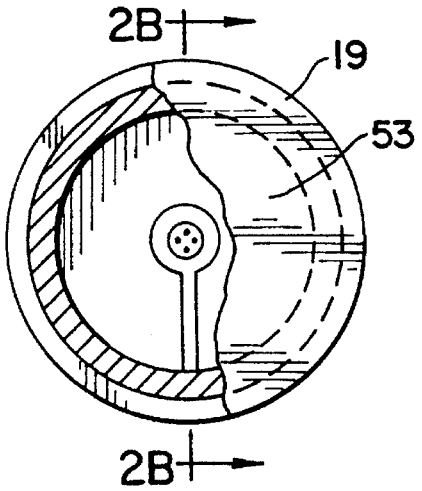
FIG. 2(A) shows an end view of the RFD linac.
Figure 2B:
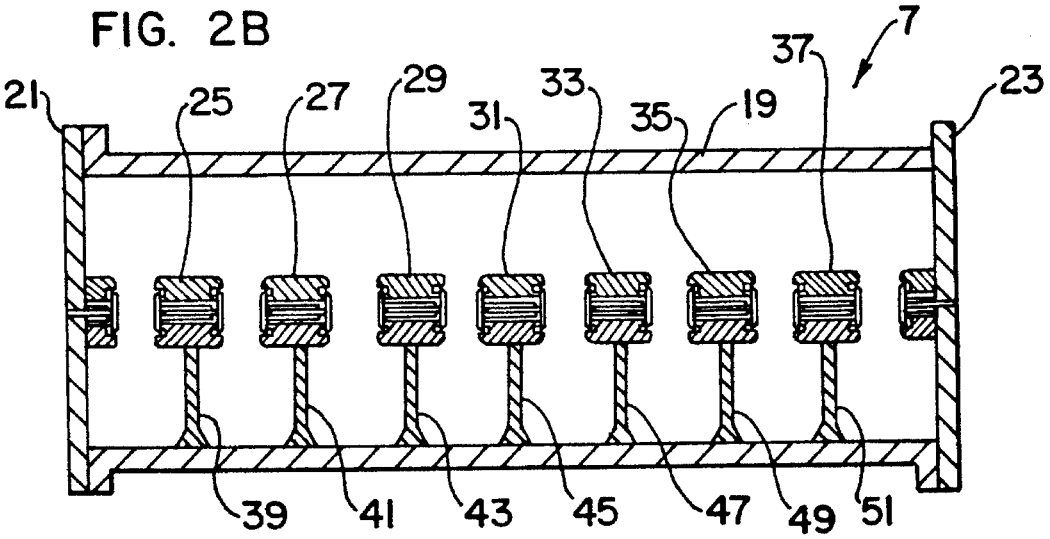
FIG. 2(B) shows a side view of the RFD linac.

An end view and a side view of a preferred embodiment of the present invention is shown in FIG. 2. The RFD linac consists of a cylindrical tank 19, terminated at some length with plane end plates 21, 23, loaded with a series of drift tubes 25, 27, 29, 31, 33, 35, 37 distributed along the axis of the tank 19 and supported from the tank wall on radial stems 39, 41, 43, 45, 47, 49, 51. The inner surface of the tank 53 must be a good electrical conductor to form a resonant cavity that can be filled with electromagnetic energy. Radio frequency (RF) is coupled into the tank 19 so as to excite the $TM_{010}$ RF cavity mode. This mode has RF electric fields running from end to end of the tank 19, parallel to the axis, and RF magnetic fields running in circles around the axis. The drift tubes along the axis and the gaps between them form a series of capacitors that become charged and discharged by the longitudinal RF electric fields of the designated RF cavity mode.

Figure 3A:
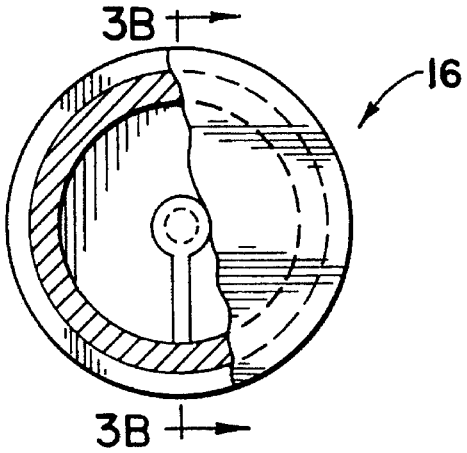
FIG. 3A PRIOR ART
FIG. 3(A) shows an end view of a conventional DTL linac.
Figure 3B:
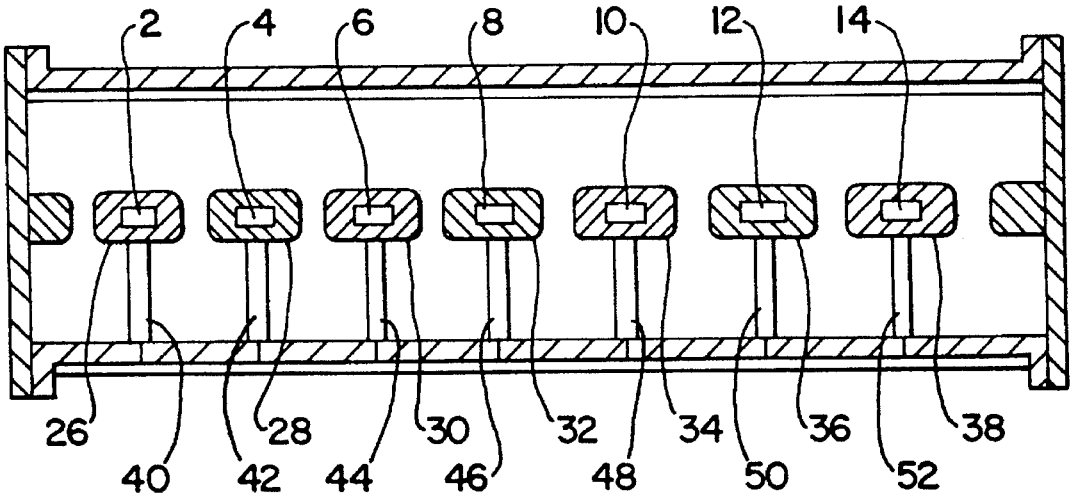
FIG. 3B PRIOR ART
FIG. 3(B) shows a side view of a conventional DTL linac.

The similarity between this new linac structure 7 and that of the conventional drift tube linac (DTL) 16 is readily apparent by comparison of the two views of the RFD linac structure 7 shown in FIG. 2 with the same views of the conventional DTL 16 shown in FIG. 3. The differences lie primarily in the design and construction of the drift tubes. In the case of the DTL linac 16, the drift tubes 26, 28, 30, 32, 34, 36, 38 comprise a single electrode containing a magnetic quadrupole lens, depicted by the rectangles 2, 4, 6, 8, 10, 12, 14 inside the drift tubes in FIG. 3, for focusing the particle beam. In the case of the RFD linac 7, the drift tubes 25, 27, 29, 31, 33, 35, 37 comprise two or more electrodes supporting four fingers that give rise to an RF quadrupole field pattern for focusing the particle beam. The simplicity and performance of the drift tubes of the new structure suggests that the new RFD linac structure will lend itself to miniaturization more readily than the magnetically focused drift tube linac structure. The smaller structures, made possible by the new RFD design, implies higher resonant frequencies, higher electrical efficiencies (less RF power requirement), and higher electrical field limits (shorter structures).

The longitudinal dimensions of linacs are normally described in terms of the distance that the particles go in one period of the RF frequency, or the "particle wavelength", which is often written symbolically as "$\beta\lambda$", where $\beta$ is the particle velocity in the units of the velocity of light, and $\lambda$ is the free space wavelength of the RF frequency.

Figure 4A:
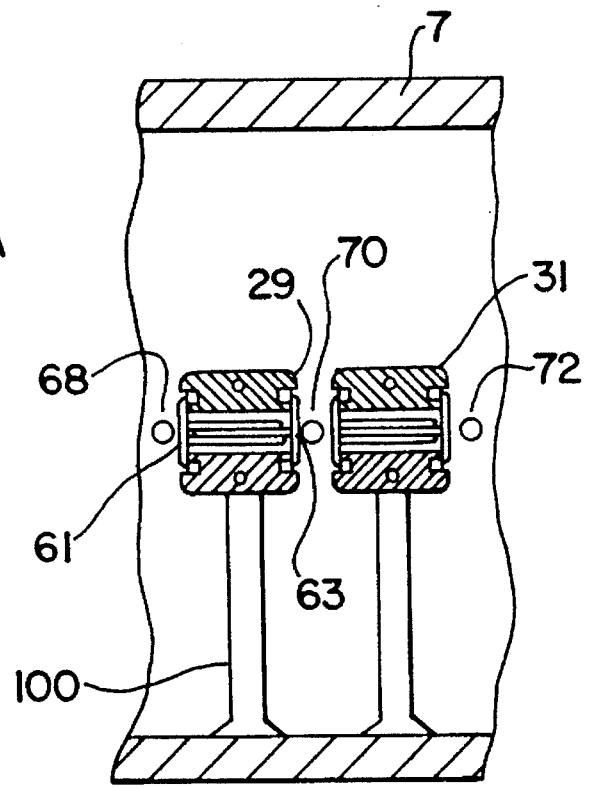
FIG. 4(A) shows a view of the RFD linac during acceleration of a particle beam.
Figure 4B:
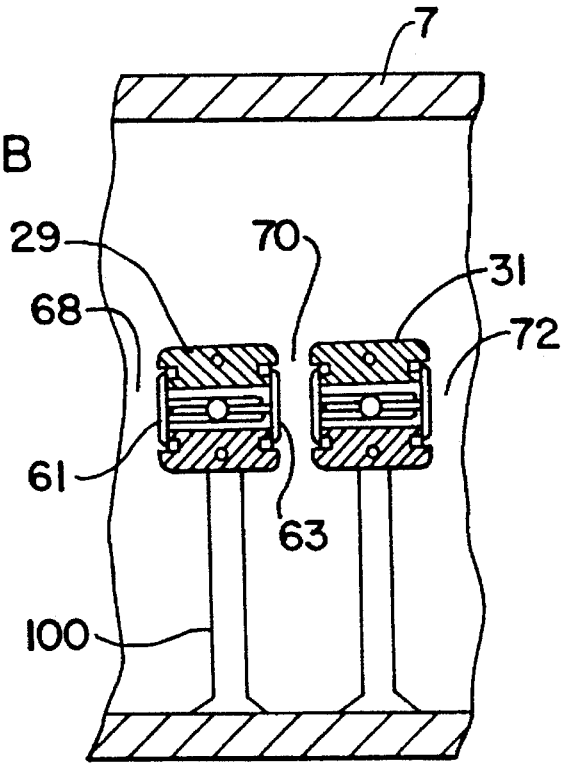
FIG. 4(B) shows a view of the RFD linac during focusing of a particle beam.

The RFD linac 7 is designed to operate on longitudinally bunched particle beams as shown in FIG. 4. Each drift tube, i.e. 29 has a hole 61, 63 at each end to allow passage of a charged particle beam along the axis of the structure. The drift tubes divide the structure into two distinct regions, namely, the regions between drift tubes, referred to as the gaps 68, 70, 72, where the acceleration takes place as shown in FIG. 4(A), and the regions inside the drift tubes 29, 31, where the focusing action takes place as shown in FIG. 4(B).

As shown in FIGS. 4, 5 and 7, the RFD linac 7 of the present invention incorporates RF quadrupole focusing into each drift tube, e.g. 29. Each drift tube (e.g. 29) of the RFD linac comprises two or more separate electrodes (81, 91) operating at different electrical potentials as determined by the RF fields in the cavity and supporting four fingers 82, 83, 92, 93 pointing towards the opposite end of the drift tube 29, forming a four-finger geometry that produces an RF quadrupole field distribution along the axis of the drift tube 29. These fields have the property that they focus the beam in one transverse plane while refocusing the beam in the orthogonal transverse plane. Preferably, the drift tube 29 is supported by a single stem 100 along the axis of a cylindrical cavity. Alternative embodiments may include two or more stems if desired for mechanical reasons.

In order to realize a net focusing action in both transverse planes, it is necessary to alternate the orientation of the quadrupole focusing elements (the four finger geometries) along the axis so as to produce a periodic succession of focusing and defocusing actions in each plane that, under proper conditions, will exhibit net focusing in each transverse plane.

The preferred configuration is to alternate focusing and defocusing actions from each drift tube to the next. In this configuration, the length of the focal period corresponds to two periods of the drift tube spacing. It is useful to define the quantity N to be the ratio of this length to the particle wavelength. As the preferred drift tube spacing is one particle wavelength, the preferred value of N is 2. Thus, the fundamental periodicity of the focusing dynamics (the distance between similar orientations of the four finger geometries) is equal to twice the particle wavelength (N=2), while the fundamental periodicity of the acceleration dynamics (the distance between acceleration gaps) is equal to one particle wavelength.

For some applications, there are mechanical and/or beam dynamical reasons to consider drift tube spacings of more than one particle wavelength and/or focal periods of more than twice the drift tube spacing. Alternate configurations of the RFD linac structure include those with drift tube spacings equal to larger integral multiples of the particle wavelength and/or focal periods corresponding to larger even integral multiples of the particle wavelength.

For example, the present RFD also contemplates configurations where the focusing periodicity is an even integral multiple, greater than two (N>2), of the particle wavelength to enhance the effective focusing strength, which has been shown to be proportional to $N^2$. This is a practical alternative for the lowest energy portions of RFD linacs, particularly where the particle wavelength is very short.

The present RFD also contemplates configurations of the acceleration periodicity where the gap-to-gap distance is an integral multiple, greater than unity, of the particle wavelength, so as to imply longer drift tubes with more internal space for focusing elements. This is also a practical alternative for the lowest energy portions of RFD linacs, particularly where the particle wavelength is very short.

Figure 5A:
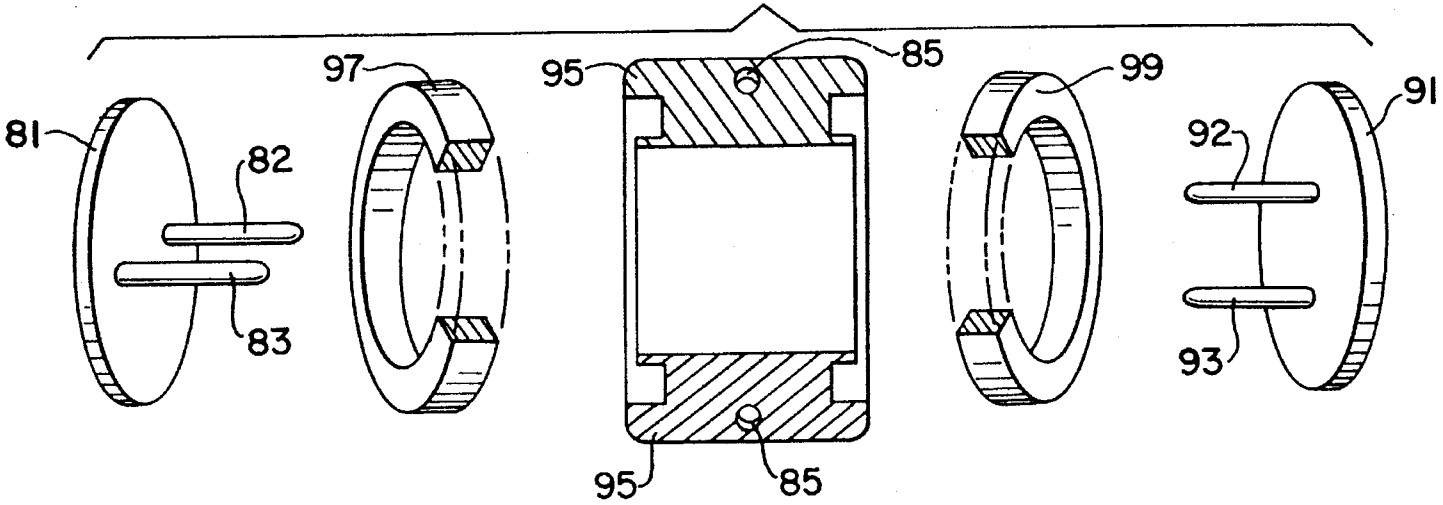
FIG. 5(A) shows an exploded view of a single drift tube of the preferred embodiment of the RFD linac.
Figure 5B:
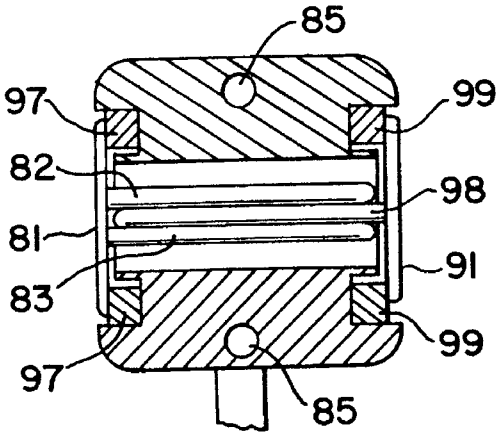
FIG. 5(B) shows an assembled view of a single drift tube of the preferred embodiment of the RFD linac.

One design for the drift tubes of the RFD linac structure is shown in FIG. 5 to include a first electrode 81 supporting two fingers 82, 83, a second electrode 91 supporting two more fingers 92, 93, a water-cooled drift tube body 95, and two ceramic insulator rings 97, 99 for joining the parts into one rigid assembly. FIG. 5(A) is an exploded view of the essential parts of this design and FIG. 5(B) shows the assembly of the parts. Many other mechanical designs, with these essential features, are possible.

Figure 6:
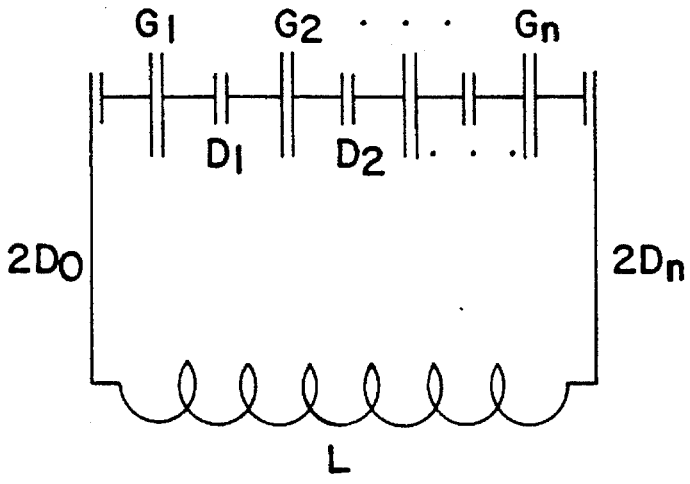
FIG. 6 shows a circuit diagram for the RFD linac.

As shown in FIG. 2, the RFD linac structure 7, consisting of a linac tank 19 together with the series of drift tubes 25, 27, 29, 31, 33, 35, 37 along the axis, represents a resonant cavity that can be filled with electromagnetic energy to produce high strength electric fields for acceleration of charged particles. The equivalent electrical circuit for this structure is shown in FIG. 6 as a simple "LC" tank circuit, consisting of an inductor, L, and a series of capacitors connected in a simple loop. The inductance of the circuit is associated primarily with the outer portions of the tank, where the majority of the magnetic fields are. As the capacitance of the circuit is associated primarily with the series of drift tubes along the axis of the structure and the gaps between them, it is appropriate that it be shown as a series of capacitors, $D_n$ and $G_n$, where $D_n$ represents the intraelectrode capacitance of the $n^{th}$ drift tube body and $G_n$ represents the capacitance of the $n^{th}$ acceleration gap. The reciprocal of the effective capacitance of the series of gaps and drift tubes, $1/C_e$, is equal to the sum of the reciprocals of the gap and drift tube capacitances. This circuit will resonate at a frequency that is proportional to the reciprocal of the square root of the product of L and $C_e$. The total voltage across the series of gaps and drift tube bodies will divide among capacitors of the circuit in proportion to the reciprocal of their respective capacitances. If the drift-tube capacitances, $D_n$, are significantly larger than the gap capacitances, $G_n$, the former will have relatively little effect on the resonant frequency of the structure and the majority of the voltage will appear across the gap capacitances for acceleration of particles, while a lesser but adequate portion of the voltage will appear across the drift-tube capacitances for focusing the particles.

The equivalent circuit for the conventional DTL is very similar to that shown in FIG. 5, where the drift tube capacitances, $D_n$, have been replaced by "short circuits" to reflect the fact that the drift tubes of the DTL structure, being a single electrode, do not contribute to the capacitance of the circuit.

Figure 7A:
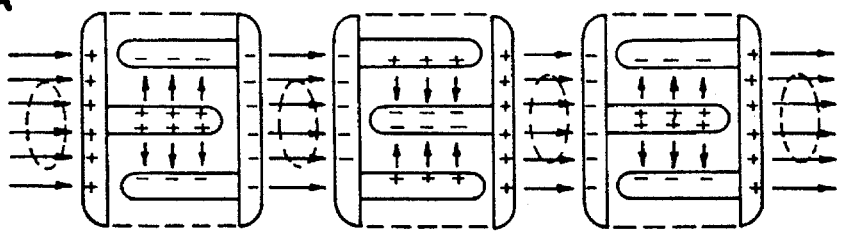
FIG. 7(A) shows a view of the field, charge, and particle distribution in the RFD linac during acceleration.

FIG. 7(A) shows a portion of a preferred configuration (N=2) of the RFD linac structure, with greatly exaggerated finger spacings, showing the distribution of electric fields (arrows) and electric charges (+ and − signs) within the structure at the "acceleration phase". The directions, shown for the fields inside the drift tubes, pertain only to the component of the fields in the plane of the figure. The components of the fields normal to the paper are in the opposite direction relative to the axis of the structure. The transverse fields vanish on the axis in both transverse planes.

The convention is that electric fields point from positive charges to negative charges, representing the direction of the force they would exhibit on "positive" beam particles. For these descriptions, the beam is assumed to be positive. The same structure will accommodate acceleration and focusing of "negative" beam particles by simply shifting the phase of all the fields by one half cycle.

Shown also in FIG. 7(A) are the location and direction of motion of the particle bunches at the "acceleration phase". The stated field convention indicates that these particles will experience forces in the direction of motion from the electric fields that will serve to accelerate them.

Figure 7B:
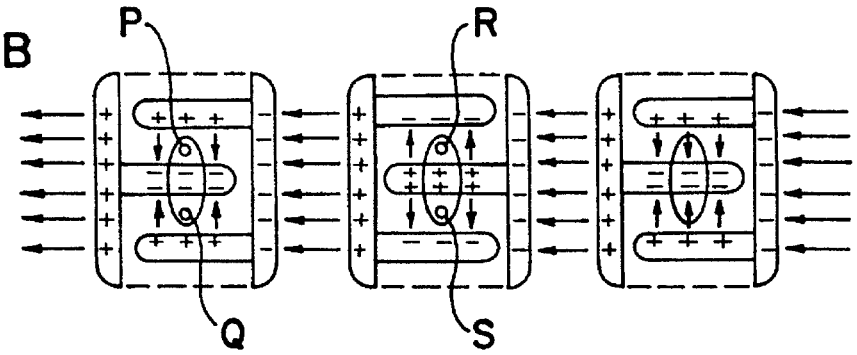
FIG. 7(B) shows a view of the field, charge, and particle distribution in the RFD linac during focusing.

FIG. 7(B) shows the same structure with the field directions and particle bunch locations as they would be at the "focusing phase". Particles traveling along the axis experience no focusing force, as the transverse fields vanish on the axis. Off-axis particles, P and Q, will experience forces directed toward the axis resulting in a "focusing" action on their motion. Off-axis particles, R and S, will experience forces directed away from the axis resulting in a "defocusing" action on their motion.

Figure 8:
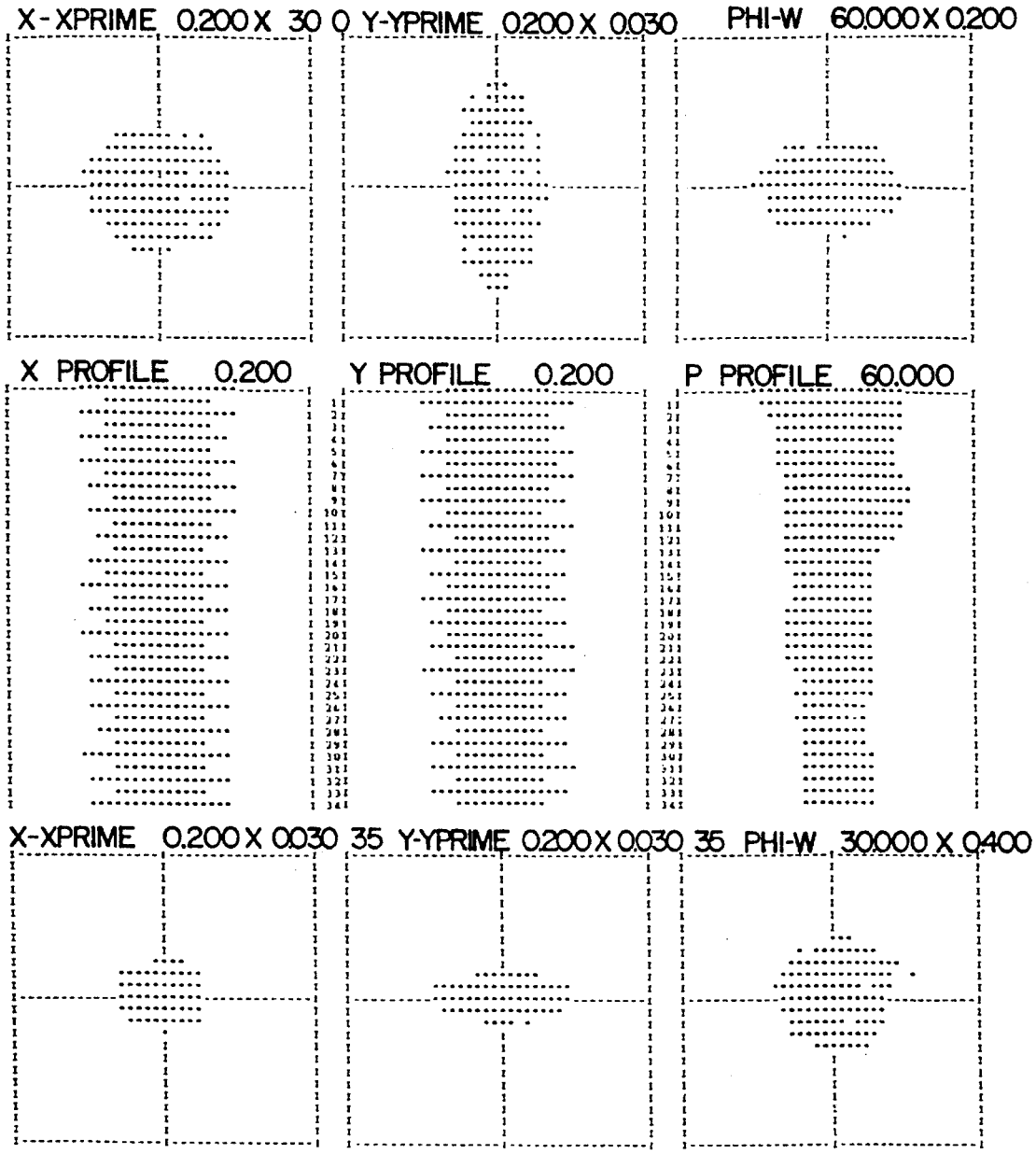
FIG. 8 shows a diagram of the calculated performance for an RFD linac.

To augment the description of the properties and the performance of this RFD linac structure, an "example" structure, with the parameters given in Table I, has been generated, resulting in the dimensions given in Table II and the performance shown in FIG. 8. A modified version of the linac design and simulation program, PARMILA, has been used to generate this "Example RFD Linac" and to simulate its performance.

All modern ion linac structures employ a periodic alternating-gradient focusing system of either the magnetostatic, electrostatic, or RF electric type. In the static versions, the alternations occur in space, whereas in the first practical RF version (the RFQ linac), the alternations occur in time with a spatial uniformity in the instantaneous fields. In the new linac structure presented here, the alternations occur in both time and space.

In any case, the general differential equation describing the particle motion is $$d^2x/dt^2+[g+h.\ \cos(wt)]x=0$$

whereas g accounts for constant linear forces and h. cos(ωt) accounts for the alternating gradient force. By changing to the independent variable n, where n=ωt/2π=ft, the equation can be written as a function of two parameters, namely $A=g/f^2$ and $B=h/f^2$.

$$\frac{d^2x}{dn^2}+[A+B\cdot\cos(2\pi n)]x=0$$

The quantity n advances by unity during each period of the focusing structure. The x,dx/dn phase space is identical to the xx'/f phase space of Smith and Gluckstern.

This is Mathieu's equation, the general properties of which are well known. It is stable for some combinations of A and B, and unstable for others. It is standard practice to map the A-B space, designating the stable and unstable regions and giving some properties of the stable motion within the stable regions.

For A=0, the equation has a range of stability from B=0 to B=17.92, where $B=(dF/dx)/(m(f/N)^2)$, dF/dx is the electromagnetic force gradient, m is the particle mass, f is the frequency of the rf, and N is the length of focal period divided by the particle wavelength. For magnetic focusing, $dF/dx=q\beta c(dB_y/dx)$, and for electric focusing $dF/dx=q(dE_x/dx)$, where q is the particle charge, βc is the particle velocity, and $B_y$ and $E_x$ are components of the focusing magnetic and electric fields respectively. The maximum acceptance for A=0 occurs at B=11.39.

In terms of the lens aperture and voltage, the focusing parameter, B, for the RFQ linac structure is given by the unitless quantity:

$$B=\frac{V\cdot\lambda^2\cdot N^2}{(M/Q)\cdot a^2}$$

where V is the voltage between the fingers of the quadrupole lens (in Volts), λ is the free-space wavelength of the RF (in meters), N (for the conventional RFQ) is unity, M/Q is the mass to charge ratio of the beam particle (in electron Volts), and a is the average radial aperture of the quadrupole lens (in meters).

The focusing parameter, B, for the RFD linac structure is approximately half that for an RFQ structure of the same frequency, vane-tip voltage and aperture, but with a focusing period corresponding to N≧2. This reflects the facts that only half of the space is dedicated to focusing and that the focusing period is N times longer than that of the RFQ structure. Hence the focusing parameter for the RFD structure (with N=2) is:

$$B=\frac{2V\lambda^2}{(M/Q)a^2}$$

For example, consider an 800 MHz RFD linac for proton acceleration with a radial aperture of 1 mm. This structure would require a total voltage on the focusing element of about 22 kV to produce a focusing parameter of about 6.6, which lies well within the stable region of the beam dynamics.

Excessive electric field strengths on metallic surfaces in vacuum lead to electrical breakdown. The limiting field strengths, as determined by W. D. Kilpatrick in 1953, are frequency dependent and, in the units of MV/m, are approximately equal to the square root of the frequency in MHz. The Kilpatrick limit for 800 MHz is about 28 MV/m. Modem vacuum and surface cleaning techniques now make it acceptable to exceed Kilpatrick's limit by approximately a factor of 2. the maximum surface electric field on the fingers in this example is 1.4×V/a=31 MV/m, or a conservative rating of 1.1 Kilpatrick.

At an average axial electric field strength of 10 MV/m, the cell length for a 2-MeV proton would be about 24 mm long and the voltage across the acceleration gap would be about 240 kV. At a proton energy of 8 MeV, the cell length would be twice as long and the gap voltage would be twice as much, or 480 kV. For these two geometries, the focusing voltages are less than 10% of the gap voltages. Hence, only a small fraction of the linac excitation is used for focusing the beam, while a majority of the excitation is used for acceleration of the beam.

A brief overview of the operation of the RFD linac will be given herein. This overview is not intended as a rigorous theoretical description of the structure, but rather, as a simple intuitive description. As the acceleration dynamics are very similar to that of the conventional DTL linac and the focusing dynamics are very similar to that of the conventional RFQ linac, the reader is referred to cited or equivalent references, for a more thorough and theoretical treatment of these dynamics.

The electric fields in the structure alternate in magnitude and direction, in a sinusoidal fashion, going through complete sinusoidal cycles at the resonant frequency of structure, which in the preferred configuration is hundreds of millions of times per second. The beam bunches have the same temporal periodicity.

The beam bunches arrive at the centers of the gaps at the times when the electric fields are optimum for acceleration, hereinafter referred to as the "acceleration phase". At this phase, the electric fields in the gaps are in the proper direction for acceleration of beam and are approaching their maximum magnitude. Typically the acceleration phase is designed to be 30° in advance of the peak magnitude in order to provide a longitudinal focusing action on the beam to keep it bunched. Associated with this choice of acceleration phase is a weak transverse defocusing action that must be overcome by additional transverse focusing incorporated into the linac structure.

The beam bunches arrive at the centers of the drift tubes one half cycle later when the electric fields have reversed their directions and are approaching their maximum magnitude in this reversed polarity. At this phase, hereinafter referred to as the "focusing phase", the fields within the drift tubes, when configured as described in this disclosure, will provide the additional transverse focusing required to keep the beam small enough to interact efficiently with the acceleration fields.

FIG. 7(A) shows a portion of a preferred configuration (N=2) of the RFD linac structure, with greatly exaggerated finger spacings, showing the distribution of electric fields (arrows) and electric charges (+ and − signs) within the structure at the "acceleration phase". The directions, shown for the fields inside the drift tubes, pertain only to the component of the fields in the plane of the figure. The components of the fields normal to the paper are in the opposite direction relative to the axis of the structure. The transverse fields vanish on the axis in both transverse planes.

Shown also in FIG. 7(A) are the location and direction of motion of the particle bunches at the "acceleration phase". The stated field convention indicates that these particles will experience forces in the direction of motion from the electric fields that will serve to accelerate them.

FIG. 7(B) shows the same structure with the field directions and particle bunch locations as they would be at the "focusing phase". Particles traveling along the axis experience no focusing force, as the transverse fields vanish on the axis. Off-axis particles, P and Q, will experience forces directed toward the axis resulting in a "focusing" action on their motion. Off-axis particles, R and S, will experience forces directed away from the axis resulting in a "defocusing" action on their motion. The principle of alternating gradient focusing establishes that a sequence focusing and defocusing forces can result in a net focusing action.

The fundamental periodicity of the RFD linac is equal to the "particle wavelength", βλ, where β is the particle velocity in units of the velocity of light and λ is the free-space wavelength of the radio frequency. As more clearly shown in FIG. 4, the drift tubes 29, 31 along the axis divide the structure into two distinct regions, namely, the regions between drift tubes, referred to as the gaps 68, 70, 72, where the acceleration takes place, and the regions inside the drift tubes 29, 31, where the focusing action takes place.

The drift tubes 29, 31 along the axis and the gaps 68, 70, 72 between them form a series of capacitors that become charged and discharged by the longitudinal RF electric fields of the designated RF cavity mode. The drift tubes 29 have a hole 61, 63 at each end to allow passage of a charged particle beam along the axis of the structure. The lengths of the drift tubes and gaps are designed so that the incoming particle bunches travel from the center of one gap to the center of the next gap in exactly an integral number of periods of the RF power, where the preferred value is one period of the RF power.

The phase of the RF field is adjusted, relative to the incoming bunches, so that the particle bunches arrive at the center of each gap at the proper phase for acceleration. This same adjustment insures that the fields will be near maximum strength, and of the opposite polarity, when the bunches arrive at the center of the drift tubes. These fields are used for focusing the particle beam bunches.

The drift tubes of the RFD linac structure comprise two or more separate electrodes operating at different electrical potentials as determined by the RF fields in the cavity and supporting four fingers to create an RF quadrupole electric field distribution along the axis. These fields have the property that they focus the beam in one transverse plane while defocusing the beam in the orthogonal transverse plane.

In a preferred configuration (N=2), the azimuthal orientation of the fingers in the drift tubes are offset by ±90° from their neighbors. This yields a focusing action that alternates from focusing to defocusing in each transverse plane as the beam progresses through the structure, which in turn yields a net focusing action in both transverse planes.

The envelope of the beam is widest in the center of the focusing region and narrowest in the center of the defocusing region. As the center of each drift tube represents the center of the focusing region for one transverse plane and the center of the refocusing region for the orthogonal transverse plane, the beam, at that location, will be widest in one transverse direction and narrowest in the orthogonal direction. As the beam travels through the structure, its cross section will alternate between an ellipse with its major axis in one transverse direction, through a circular cross section, to an ellipse with its minor axis in that same direction and then back again. On average, the beam cross section will be circular.

The preferred embodiment of a single drift robe is shown in FIG. 5. The two pairs of fingers 82, 83, 92, 93 supported on the two electrodes 81, 91 in the drift tube carry opposite charges such that the net charge on the drift tube is zero. The two electrodes 81, 91 are preferably supported through thin rings of ceramic 97, 99 from a water-cooled ring 85 to form a rigid drift tube unit, which is supported from the tank wall on a single, electrically conducting stem. The limited power dissipation on the drift tube electrodes 81, 91 and in the ceramic rings 97, 99 can be conducted through the ceramic 97, 99 to the cooled ring 95.

Alternatively, the two electrodes of the drift tube can be joined into one rigid unit by an appropriately shaped electrical conductor, which in mm is supported from the tank wall by one or more electrically conducting stem. This embodiment enjoys the advantages of a rigid drift tube unit while obviating the need for the ceramic insulating tings of the preferred embodiment, and offers improved cooling of the electrodes. The shape and orientation of the conductor must be determined so as not to "short out" the RF excitation of the drift tube unit. This would be one of the preferred embodiments for high average power applications.

In another embodiment suitable for high average power applications, each of the two electrodes in the drift tube can be supported and cooled independently from the tank wall on one or more electrically conducting stems. This embodiment obviates the need for the ceramic insulating rings of the preferred embodiment and offers improved cooling of the electrodes. This, also, would be one of the preferred embodiments for high average power applications.

The choice of operating frequency is important because as the operating frequency is increased, the RF efficiency increases, the size of the structure decreases, and the space charge limited beam current decreases. The goal is to choose the operating frequency as high as possible, consistent with a high enough beam current limit. Most RFQ linacs have been designed for RF frequencies of 450 MHz or less. In contrast, the present RFD allows for frequencies as high as 800 MHz. The higher frequency will result in a smaller structure with less power consumption and a lower beam current capability. The lower beam current is not a serious penalty, because the present RFD is designed to handle peak currents in the order of 25–30 mA. This, together with a pulse duty factor of 1%, implies an average beam current of 250–300 μA, which is adequate for many commercial applications.

The preferred single-tank, single-frequency aspect of the present RFD linac allows the use of a self-excited RF power system that would eliminate much of the cost and complexity of conventional RF power systems. Most RF experts agree that it is easy to make an RF amplifier oscillate. Some feedback mechanism between the RF power in the linac structure and the input to the power amplifier should suffice.

The RFD may be powered directly by this self-excited technique, as shown in FIG. 1. The RF amplifiers for the RFQ linac would get their drive power from the RFD structure. A simple, temperature controlled system will keep the relatively broad-band RFQ system in resonance with the narrower-band RFD system. This simple system obviates the need for an accurate frequency source, a low-level RF power amplifier chain, precise resonance control on the linac structure, and all of the associated power supplies and controls.

This structure uses both phases of the RF electric field to effect the beam; one for accelerating the beam and the other for focusing the beam. The "reverse phase" does not decelerate the beam because the fields inside the drift tubes are distorted into transverse focusing fields with little longitudinal component. The orientation of the fingers in the focusing regions alternate so as to create an alternating focusing and defocusing action of the beam in each transverse plane.

The structure has excellent properties with the changing geometry associated with the acceleration process. As the particle velocity increases, the cell length increases and the acceleration gap capacitance decreases. In a constant gradient configuration, typical of most drift tube linacs, an increase in cell length implies an increase in the acceleration voltage. If the intra-electrode capacitance of the drift robe body (and the focusing fingers) is approximately constant, regardless of the drift tube length, the focusing voltage remains approximately constant while the acceleration voltage increases with particle velocity. This implies a constant beam diameter throughout the structure.

The fact that the transverse focusing is electric and unchanged in strength from conventional RFQs means that the beams in this new structure will have the same small diameter that they do in conventional RFQs, and that matching the beam from an RFQ into the RFD linac will be relatively simple. It is well established that the small diameter beams as found in RFQ linacs preserve beam quality better than the larger beams found in magnetically focused DTL linacs.

The DTL structure, described here as simply a linac tank containing an array of drift tubes, has an inherent weakness associated with the stability of the RF energy distribution of the specified $TM_{010}$ RF cavity mode along the length of the structure. In longer linac structures, this problem can result in the loss of control of the acceleration process. In turn, this can result in degradation of the particle beam quality and, eventually, in the loss of particles of the beam on portions of the accelerator. The solution to this problem, for the DTL structure, involves the addition of an array of resonant "post couplers" (U.S. Pat. No. 3,501,734) along the tank wall to provide a much improved RF power flow mechanism for this RF cavity mode that greatly enhances the stability of the RF energy distribution within the structure. The RFD structure, which uses the same RF cavity mode in a very similar geometry, will have this same problem. The same solution, namely the incorporation of an array of "post couplers" into the structure, will work for the RFD structure. It is anticipated that longer RFD structures will employ this solution to this problem.

An example of a small RFD Linac of the preferred N=2 configuration is presented in Tables I and II and in FIG. 8. This compact proton linac, with a total of 35 cells and a diameter of 0.25 meters, accelerates a 2 millimeter diameter proton beam from 1 to 10 MeV in a length of only 1.25 meters. It operates at 800 MHz and has an average axial electric field of 10 million volts/meter. The estimated RF power required to excite the structure is 1 megawatt. Some details of the geometry and associated voltages are presented in Table II.

The six similar graphs at the top and bottom of FIG. 8 show the two-dimensional "phase spaces" of the simulated beam at the entrance (top graphs) and exit (bottom graphs) of the linac. These spaces show the range of the acceptable position and angle coordinates of the beam for each transverse coordinate (x on the left, y in the center) and the longitudinal coordinate (phi on the right). The area occupied by the beam in these spaces is referred to as the "emittance" of the beam and is an important measure of the transverse and longitudinal focusing capabilities of the structure. The emittance of the simulated beam at the entrance to the structure is 1.3 cm-mrad in each of the transverse coordinates and 4.7 cm-mrad in the longitudinal coordinate. The vertical bands in the center of the figure show the profiles of the beam as it passes through the 35 cells of the structure.

TABLE I

Parameters of Example RFD Linac

| | |
|---|---|
| Injection Energy | 1 MeV |
| Final Energy | 10 MeV |
| Length | 1.25 meters |
| Diameter | 0.25 meters |
| Resonant Frequency | 800 Mhz |
| Number of Cells | 35 |
| Rf Power (peak) | 1.0 MW |
| Average Axial Electric Field | 10 MV/m |
| Emittance (transverse, at entrance) | 1.3 cm-mrad |
| Emittance (longitudinal, at entrance) | 4.7 cm-mrad |

TABLE II

Dimensions and Excitations of Example RFD Linac

| Cell Number | Beam Energy (MeV) | D.T. Length (mm) | Gap Length (mm) | Gap Voltage (kV) | RF Qua Voltage (kV) | Total Length (mm) |
|---|---|---|---|---|---|---|
| 0 | 1.00 | | | | | 00.0 |
| 1 | 1.13 | 14.2 | 3.6 | 178 | 22 | 17.8 |
| 2 | 1.26 | 15.0 | 3.8 | 188 | 22 | 36.6 |
| 3 | 1.41 | 16.0 | 4.0 | 200 | 22 | 56.6 |
| 4 | 1.56 | 16.8 | 4.2 | 210 | 22 | 77.6 |
| 5 | 1.72 | 17.7 | 4.4 | 221 | 22 | 99.7 |
| 6 | 1.88 | 18.5 | 4.6 | 231 | 22 | 122.8 |
| 7 | 2.06 | 19.4 | 4.8 | 242 | 22 | 147.0 |
| 8 | 2.24 | 20.2 | 5.1 | 253 | 22 | 172.3 |
| 9 | 2.43 | 21.0 | 5.3 | 263 | 22 | 198.6 |
| 10 | 2.63 | 21.9 | 5.5 | 274 | 22 | 226.0 |
| 11 | 2.83 | 22.8 | 5.7 | 285 | 22 | 254.5 |
| 12 | 3.04 | 23.6 | 5.9 | 295 | 22 | 284.0 |
| 13 | 3.26 | 24.6 | 6.1 | 307 | 22 | 314.7 |

TABLE II-continued

Dimensions and Excitations of Example RFD Linac

| Cell Number | Beam Energy (MeV) | D.T. Length (mm) | Gap Length (mm) | Gap Voltage (kV) | RF Qua Voltage (kV) | Total Length (mm) |
|---|---|---|---|---|---|---|
| 14 | 3.49 | 25.3 | 6.3 | 316 | 22 | 346.3 |
| 15 | 3.72 | 26.2 | 6.6 | 328 | 22 | 379.1 |
| 16 | 3.97 | 27.0 | 6.8 | 338 | 22 | 412.9 |
| 17 | 4.22 | 27.8 | 7.0 | 348 | 22 | 447.7 |
| 18 | 4.48 | 28.7 | 7.2 | 359 | 22 | 483.6 |
| 19 | 4.74 | 29.6 | 7.4 | 370 | 22 | 520.6 |
| 20 | 5.02 | 30.4 | 7.6 | 380 | 22 | 558.6 |
| 21 | 5.30 | 31.3 | 7.8 | 391 | 22 | 597.7 |
| 22 | 5.59 | 32.2 | 8.0 | 402 | 22 | 637.9 |
| 23 | 5.88 | 33.0 | 8.2 | 412 | 22 | 679.1 |
| 24 | 6.19 | 33.8 | 8.5 | 423 | 22 | 721.4 |
| 25 | 6.50 | 34.6 | 8.7 | 433 | 22 | 764.7 |
| 26 | 6.82 | 35.5 | 8.9 | 444 | 22 | 809.1 |
| 27 | 7.14 | 36.3 | 9.1 | 454 | 22 | 854.5 |
| 28 | 7.48 | 37.2 | 9.3 | 465 | 22 | 901.0 |
| 29 | 7.82 | 38.0 | 9.5 | 475 | 22 | 948.5 |
| 30 | 8.17 | 38.9 | 9.7 | 486 | 22 | 997.1 |
| 31 | 8.53 | 39.7 | 9.9 | 496 | 22 | 1046.7 |
| 32 | 8.89 | 40.6 | 10.1 | 507 | 22 | 1097.4 |
| 33 | 9.26 | 41.4 | 10.3 | 517 | 22 | 1149.1 |
| 34 | 9.64 | 42.2 | 10.5 | 527 | 22 | 1201.8 |
| 35 | 10.03 | 43.0 | 10.8 | 538 | 22 | 1255.6 |

What is claimed is:

1. A drift tube linear accelerator comprising a cylindrical tank excited with RF fields in the $TM_{010}$ RF cavity mode, said tank having an input for receiving a particle beam and an output for emitting said particle beam at a higher energy level;

a plurality of drift tubes axially arranged in said tank, said plurality of drift tubes being configured to define an acceleration gap between each drift tube, wherein said particle beam is accelerated as it traverses through said gap and wherein said particle beam is focused as it traverses through said drift tube, said drift tube comprising:

a first electrode supporting a first pair of fingers protruding substantially into the center of said drift tube from a first end of said drift tube, said first pair of fingers lying in a first plane;

a second electrode supporting a second pair of fingers protruding substantially into the center of said drift tube from a second end of said drift tube opposite of said first end, said second pair of fingers lying in a second plane substantially perpendicular to said first plane; and means for supporting said first electrode and said second electrode along said axis of said tank;

wherein said pairs of fingers form a four finger geometry and wherein said first and second electrodes have alternating RF electrical potentials of different magnitudes, said potential differences establishing RF electric quadrupole fields in a region between said pairs of fingers, said focusing of said particle beam resulting from said RF electric quadrupole fields.

2. The drift tube linear accelerator of claim 1, wherein said four finger geometries are oriented at a fundamental periodicity substantially equal to twice the particle wavelength, said distance between acceleration gaps being substantially equal to one particle wavelength.

3. The drift tube linear accelerator of claim 1, wherein said four finger geometry is oriented such that the fundamental periodicity of said four finger geometries is an even integral multiple of the particle wavelength.

4. The drift tube linear accelerator of claim 1, wherein the lengths of said drift tubes and said acceleration gaps are increased such that the fundamental periodicity of said distance between said acceleration gaps is an integral multiple of the particle wavelength.

5. The drift tube linear accelerator of claim 1, wherein said means for supporting said first electrode and said second electrode comprises ceramic rings supported at midplane by a metallic ring on a single stem, wherein said stem conducts dissipated power from said electrodes and said rings, said metallic ring and said stem being cooled by water.

6. The drift tube linear accelerator of claim 1, wherein an appropriately shaped conductor joins said first electrode with said second electrode, said conductor being supported from said tank wall by one or more stems.

7. The drift tube linear accelerator of claim 1, wherein each said electrode is supported independently from said tank wall by a single stem.

8. The drift tube linear accelerator of claim 1, wherein said accelerator operates in the range of about 200 MHZ to about 450 MHz.

9. The drift tube linear accelerator of claim 1, wherein said accelerator operates at a frequency substantially greater than 400 MHz.

10. The drift tube linear accelerator of claim 1, wherein said outer walls of said tank include post couplers to stabilize longitudinally distributed electromagnetic energy within said tank.

* * * * *